US007611450B2

(12) United States Patent
Mancini

(10) Patent No.: US 7,611,450 B2
(45) Date of Patent: Nov. 3, 2009

(54) PORTABLE, COLLAPSIBLE EXERCISE MACHINE

(76) Inventor: Paul Mancini, 3689 Seminole Road, Windsor, ON (CA) N8Y 1Y5

( * ) Notice: Subject to any disclaimer, the term of this patent is extended or adjusted under 35 U.S.C. 154(b) by 3 days.

(21) Appl. No.: 11/712,464

(22) Filed: Mar. 1, 2007

(65) Prior Publication Data

US 2008/0214369 A1 Sep. 4, 2008

(51) Int. Cl.
*A63B 21/04* (2006.01)
*A63B 21/02* (2006.01)

(52) U.S. Cl. ..... 482/130; 482/123

(58) Field of Classification Search ..... 482/72, 482/129–130, 95–96, 123, 121
See application file for complete search history.

(56) References Cited

U.S. PATENT DOCUMENTS 4,611,805 A 9/1986 Franklin
5,007,632 A * 4/1991 Wilkinson ..... 482/72
5,324,243 A * 6/1994 Wilkinson ..... 482/92
5,833,582 A * 11/1998 Chen ..... 482/57
5,993,361 A 11/1999 Paoli et al.
5,997,448 A * 12/1999 Duba ..... 482/121
6,099,445 A * 8/2000 Rovinsky et al. ..... 482/121
6,110,081 A 8/2000 Barrett
6,159,133 A * 12/2000 Shugg ..... 482/130
6,220,994 B1 * 4/2001 Rich ..... 482/123
6,394,938 B1 * 5/2002 Tornabene ..... 482/142
6,500,104 B1 * 12/2002 Rich ..... 482/123
2006/0160681 A1 * 7/2006 McBride et al. ..... 482/123

* cited by examiner

*Primary Examiner*—Fenn C Mathew
(74) *Attorney, Agent, or Firm*—Miller Thomson LLP

(57) ABSTRACT

A portable, collapsible exercise machine having an adjustable support member having a first portion having a first end and a second end and a second portion having a first end and a second end. The portable collapsible exercise machine further includes a removable, adjustable T-bar arm member adapted to adjustably engage the first end of the first portion, and a removable, adjustable T-bar foot member adapted to adjustably engage the second end of the second portion. Removable resistance members adapted to engage the adjustable support member, the removable, adjustable T-bar arm member and the removable, adjustable T-bar foot member are also included. The second end of the first portion is hinged to the first end of the second portion at a point so as to allow the first and second portions to fold back onto one another into a collapsed position.

18 Claims, 7 Drawing Sheets

PORTABLE, COLLAPSIBLE EXERCISE MACHINE

FIELD OF THE INVENTION

This invention relates in general to exercise machines and more particularly to a portable, collapsible exercise machine with the ability to exercise the abdominal and arms using transferable resistance cords.

BACKGROUND OF THE INVENTION

There are numerous types of exercise devices, and portable exercise devices have become more popular as they provide a convenient alternative to costly health club memberships. There are a wide variety of exercise machines on the market that concentrate or work individual parts of the body, such as abdominal curling apparatuses, arm weights, resistant leg bands, large abdominal exercising balls by way of example only. The majority of these devices however only allow the user to work one part of the body at a time such as the arms or the legs. Furthermore some of these devices although technically portable are not collapsible into an easy travelling size and weight.

Prior art portable exercise devices have been devised to address the some of these issues. For example, United States Patent Appln. No. 2006/0160681 was filed on Jan. 11, 2006 by McBride et al. and relates to a portable workout apparatus comprising a bar, a frame, and a padded structured secured to the frame. The bar is held at an adjustable bar height. The frame supports the bar at the adjustable bar height. The padded structure is secured to the frame, and has a first portion and a second portion. The first and second portions have a deployed position forming a substantially horizontal surface that forms an opening with the bar and the frame that is adapted to accommodate a user. The first portion is further capable of pivoting, relative to the second portion, to a substantially vertical position for storage.

Barrett is the owner of U.S. Pat. No. 6,110,081 which issued on Aug. 29, 2000 and relates to a portable resistance-type exercise apparatus has a hinged, padded platform to support the head and back, a rigid frame including two curved tubes running along either side of the platform, and an elastic cord disposed inside each tube. Each elastic cord has a hand grip for allowing the user to grip the cords securely when doing abdominal exercises. To use the apparatus while doing an abdominal crunch, the user holds onto the hand grips and lifts the torso while pulling the hand grips away from the head and toward the knees at the same time. The resistance provided by the elastic cords increases the effort required to lift the torso, strengthening the abdominal muscles more quickly than conventional abdominal crunches. The apparatus can also be attached upright to a chair for exercising different muscles in the arms, shoulders and back by changing the direction in which the elastic cords are pulled.

U.S. Pat. No. 5,993,361 which issued on Nov. 30, 1999 to Paoli and relates to a portable, multi-configurable exercise apparatus including a first pair of parallel spaced elongate rigid members having an outer and an inner rigid member and a second pair of parallel spaced elongate rigid members having an outer and an inner rigid member. The first pair of elongate rigid members being coupled to the second pair of elongate rigid members by a pair of elongate guide members parallel spaced and transverse to the first and second pairs of rigid members. The outer and inner rigid members of each pair of rigid members being separated by at least one elastic member for providing variable resistance between each inner member and respective outer member.

Thus a portable, collapsible exercise machine which allows for the user's abdominals and arms to be exercised and is easy to transport and set up is desirable.

SUMMARY OF THE INVENTION

An object of one aspect of the present invention is to provide an improved portable, collapsible exercise machine with the ability to exercise the abdominal and arms using transferable resistance cords.

In accordance with one aspect of the present invention there is provided a portable, collapsible exercise machine having an adjustable support member having a first portion having a first end and a second end and a second portion having a first end and a second end. The portable collapsible exercise machine further includes a removable, adjustable T-bar arm member adapted to adjustably engage the first end of the first portion, and a removable, adjustable T-bar foot member adapted to adjustably engage the second end of the second portion. Removable resistance members adapted to engage the adjustable support member, the removable, adjustable T-bar arm member and the removable, adjustable T-bar foot member are also included. The second end of the first portion is hinged to the first end of the second portion at a point so as to allow the first and second portions to fold back onto one another into a collapsed position.

Conveniently, a series of attachment zones adapted to engage the removable resistance members are located at the hinged point connecting the first and second portions, at the adjustable T-bar arm member and at the adjustable T-bar foot member.

Preferably, the removable resistance members are further defined as resistance elastomeric tubing and further comprise safety socks that encompass the removable resistance members and secure to the first end and the second end of the resistance elastomeric tubing.

Advantages of the present invention are: the ability to transport and set up a portable exercise machine in a wide variety environments, a convenient collapsible format that is light weight and easy for seniors to use, a wide variety of exercises may be performed, various exercise attachment accessories are available, three different points for attaching the accessories allowing for arm and abdominal exercises, easy attachment zones for quick assembly and disassembly, three different positions for adjustment of the seat, comfortable handles on all accessories, safety sock around the resistance tubing to limit the possibility of injury, and the portable exercise machine grows with the athlete from beginner to professional.

BRIEF DESCRIPTION OF THE DRAWINGS

A detailed description of the preferred embodiments is provided herein below by way of example only and with reference to the following drawings, in which.

Figure 1:
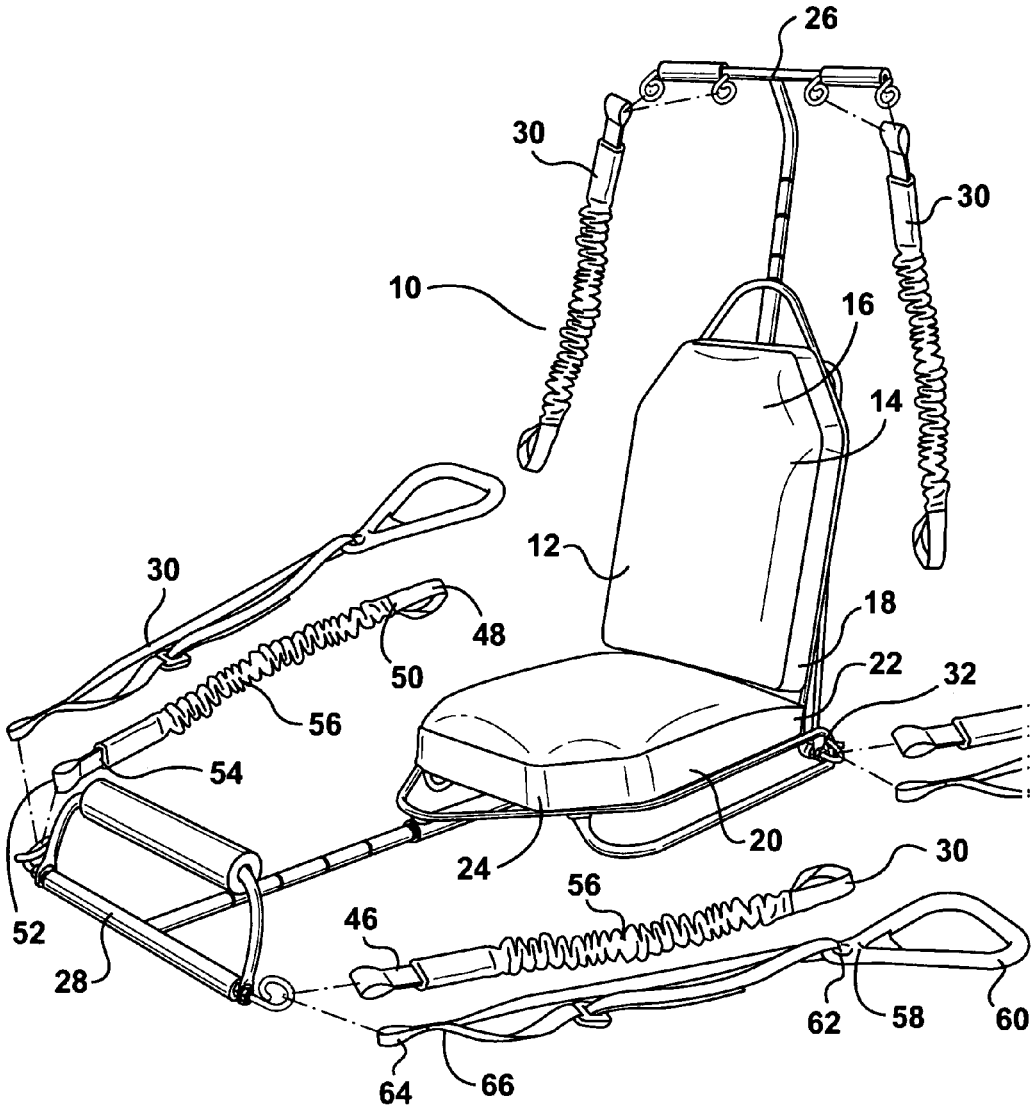
FIG. 1 in a perspective view, illustrates a portable collapsible exercise machine in accordance with the preferred embodiment of the present invention.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Figure 2:
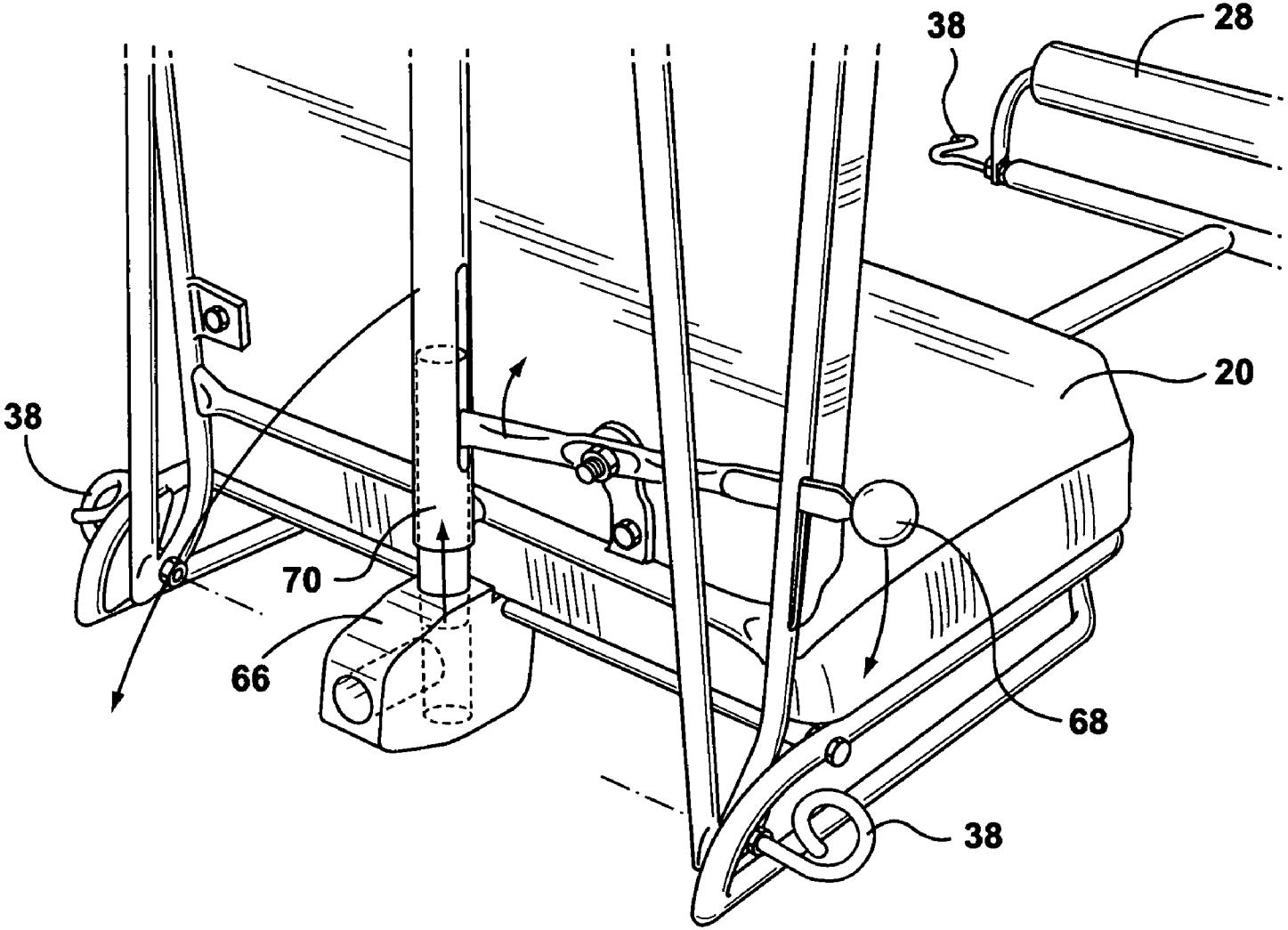
FIG. 2 in a back perspective view, illustrates the portable collapsible exercise machine of FIG. 1.
Figure 3:
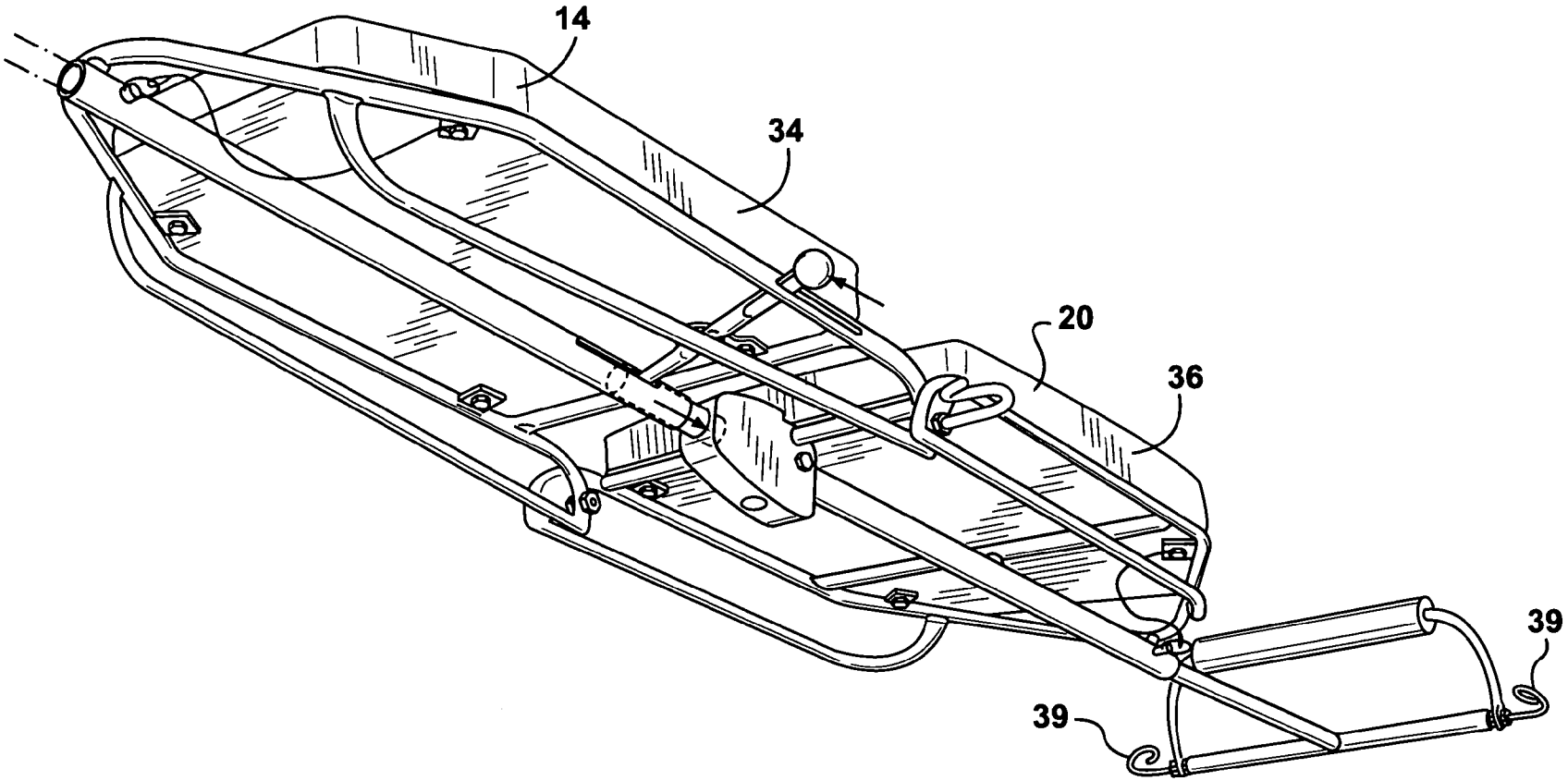
FIG. 3 in a back perspective view, illustrates the portable collapsible exercise machine of FIG. 1.

Referring to FIGS. 1 to 3, there is illustrated in perspective views, a portable, collapsible exercise machine 10 in accordance with a preferred embodiment of the present invention. The portable, collapsible exercise machine 10 includes an adjustable support member 12 having a first portion 14 having a first end 16 and a second end 18 and a second portion 20 having a first end 22 and a second end 24. The portable collapsible exercise machine 10 further includes a removable, adjustable T-bar arm member 26 adapted to adjustably engage the first end 16 of the first portion 14, and a removable, adjustable T-bar foot member 28 adapted to adjustably engage the second end 24 of the second portion 20. Removable resistance members 30 adapted to engage the adjustable support member, the removable, adjustable T-bar arm member 26 and the removable, adjustable T-bar foot member 28 are also included. The second end 18 of the first portion 14 is hinged to the first end 22 of the second portion 20 at a point 32 so as to allow the first and second portions 14 and 20 to fold back onto one another into a collapsed position.

Figure 6:
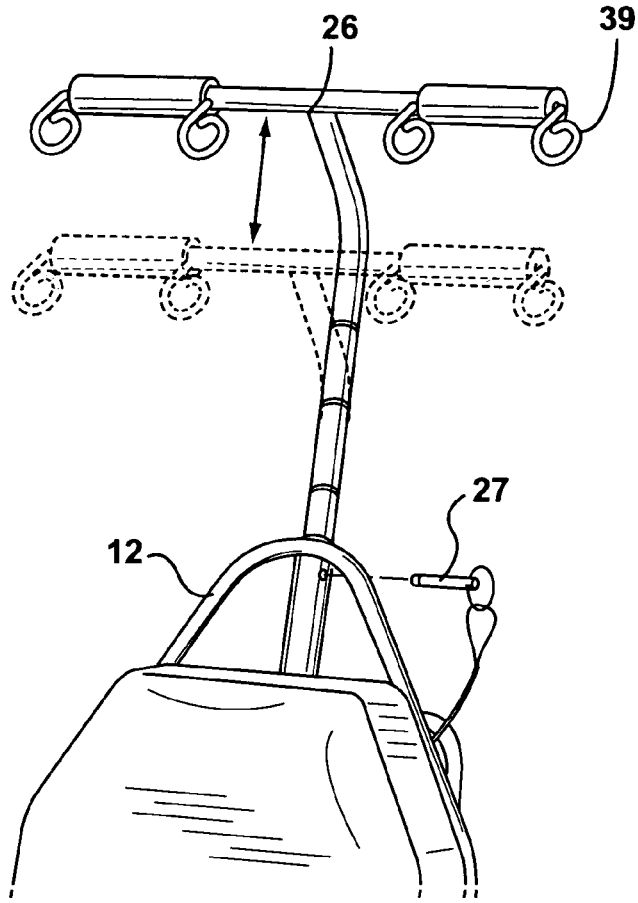
FIG. 6 in a partial perspective view, illustrates the portable collapsible exercise machine of FIG. 1 showing the adjustment of the T-bar arm member.
Figure 7:
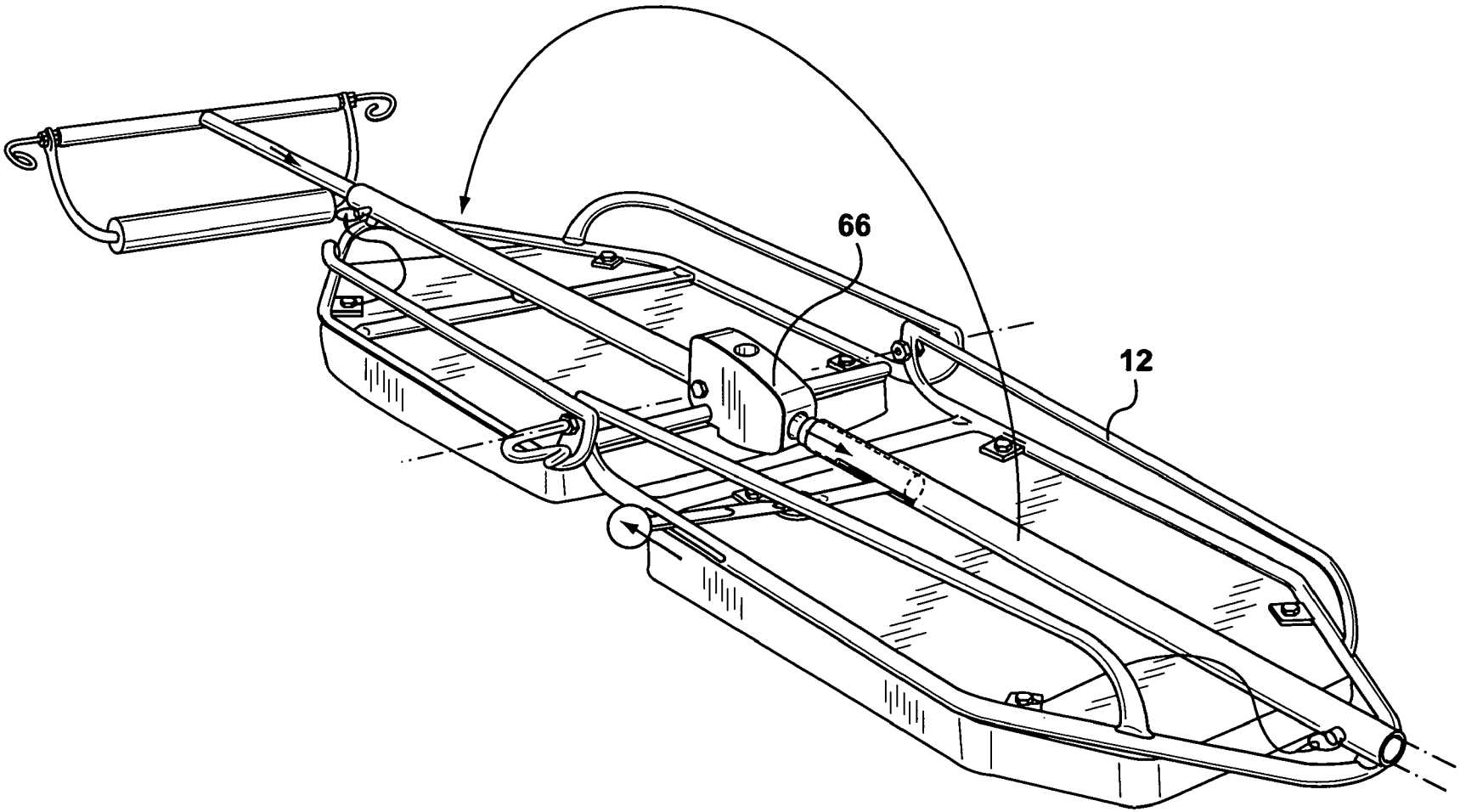
FIG. 7 in a bottom perspective view, illustrates the portable collapsible exercise machine of FIG. 1.
Figure 8:
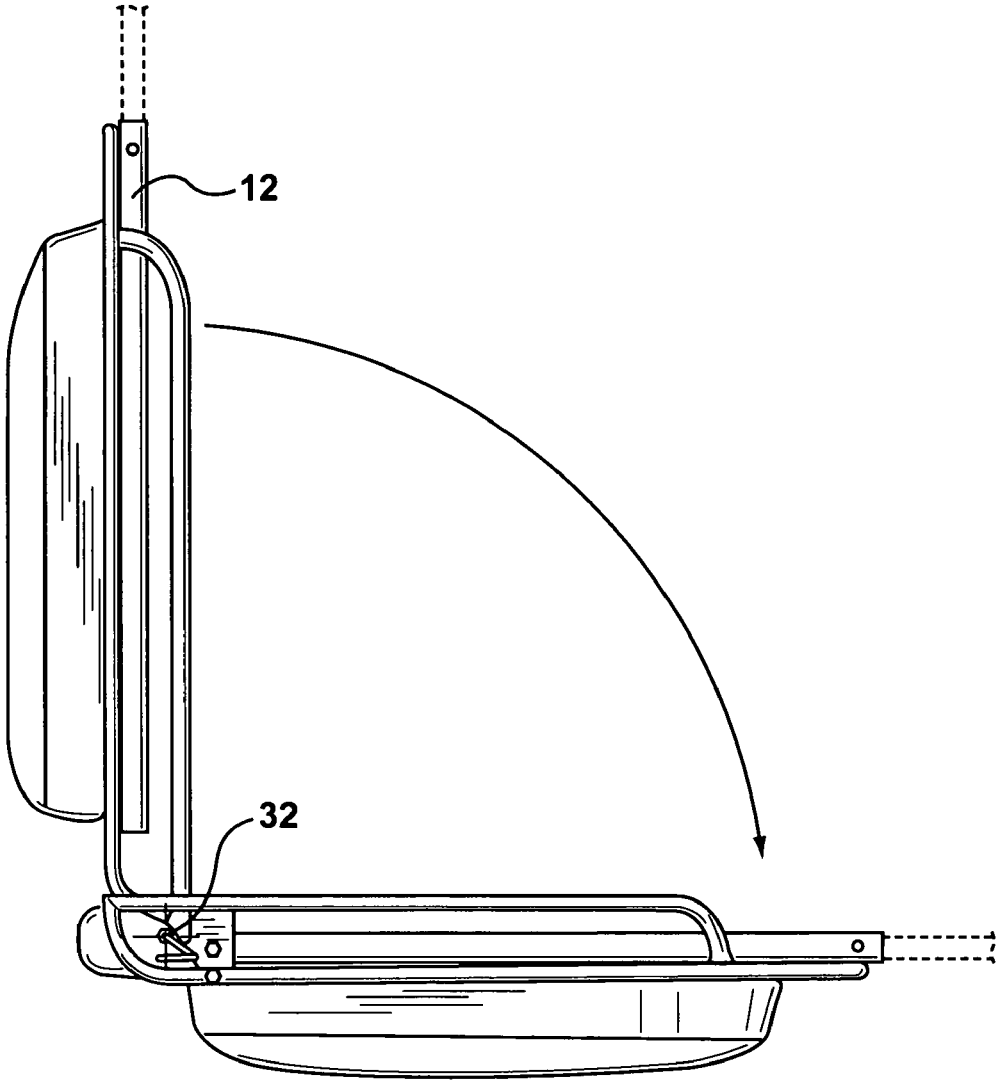
FIG. 8 in a side view, illustrates the portable collapsible exercise machine of FIG. 1 oriented in a 90° angle.
Figure 9:
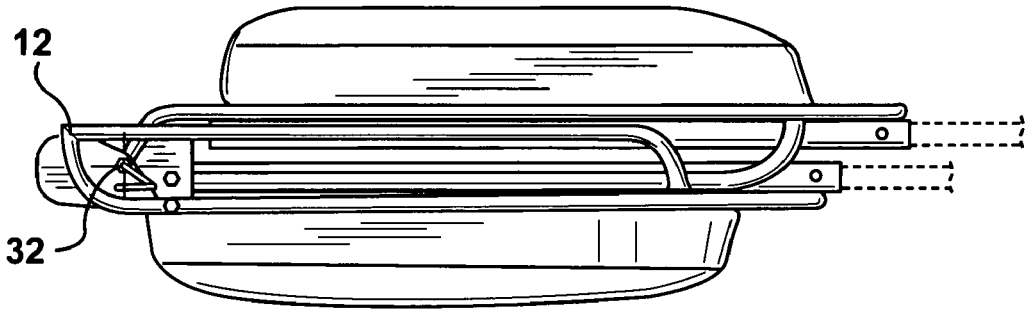
FIG. 9 in a side view, illustrates the portable collapsible exercise machine of FIG. 1 oriented in a collapsed position.

The first portion 14 may be further defined as a padded back support member 34 and the second portion 20 may be further defined as a padded seat support member 36. The hinged point 32 connecting the first and second portions 14 and 20, further includes a series of attachment zones 38 adapted to engage the removable resistance members 30. The removable, adjustable T-bar arm member 26 includes a series of attachment zones 39 adapted to engage the removable resistance members 30. Referring to FIG. 6, the removable, adjustable T-bar arm member 26 includes a removable locking pin 27 that allows the T-bar arm member 26 to be adjusted to a variety of lengths away from the adjustable support member 12 thereby accommodating different heights of users. Furthermore the T-bar arm member can have numerous attachment zones 39 so as to attach various accessories to accomplish various exercises such as pull downs, and may be padded for additional comfort.

Figure 4:
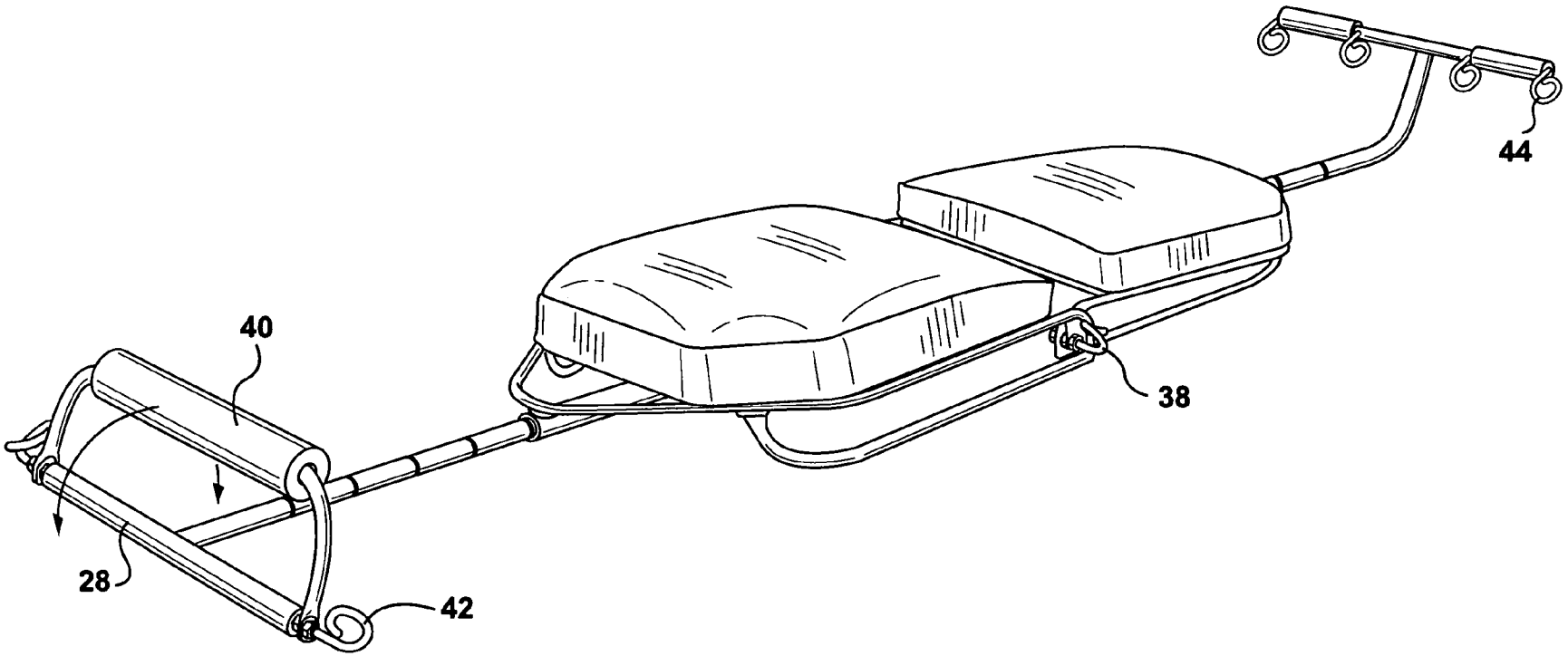
FIG. 4 in a front perspective view, illustrates the portable collapsible exercise machine of FIG. 1.
Figure 5:
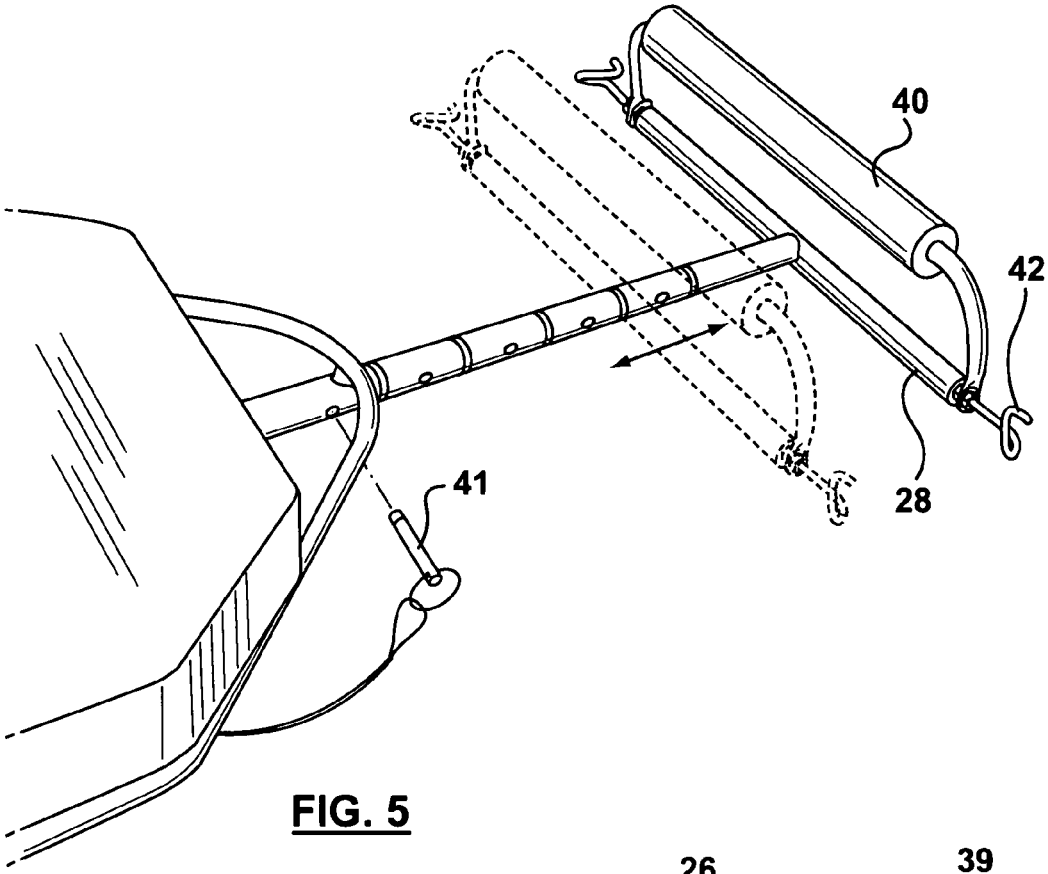
FIG. 5 in a partial perspective view, illustrates the portable collapsible exercise machine of FIG. 1 showing the adjustment of the T-bar foot member.

Referring to FIGS. 4 and 5 the removable, adjustable T-bar foot member 28 further includes an adjustable foot anchor 40 that swivels back and forth about the T-bar foot member 28 so as to securely accommodate different sized feet. More specifically a user with small feet can easily move or swivel the adjustable foot anchor 40 down to contact the tops of the feet and therefore provide support for the user during exercise. The removable, adjustable T-bar foot member also includes a series of attachment zones 42 adapted to engage the removable resistance members 30. The removable, adjustable T-bar foot member 28 includes a removable locking pin 41 that allows the T-bar foot member 28 to be adjusted to a variety of lengths away from the adjustable support member 12 thereby accommodating different lengths of the user's legs.

The various attachment zones 38, 39 and 42 may be better defined as pigtail loops 44 that allow for the easy attachment and detachment of the removable resistance members 30. More specifically the resistance members 30 can easily slide onto the end of the pigtail loops 44 which securely hold the resistance members 30 during their use.

The removable resistance members 30 are further defined as resistance elastomeric tubing 46 that can provide resistance in a range between 0 and 140 pounds. As such the resistance is adjustable to accommodate the fitness level of the user. The resistance elastomeric tubing 46 can have flexible handles 48 at a first end 50 and a flexible loop 52 at a second end 54 which is adapted to engage the attachment zones 38, 39 and 42 or pigtail loops 44. The flexible handles 48 provide easy comfort to the user during exercise.

The removable resistance members 30 also include safety socks 56 that encompass the removable resistance members 30 and are secured to the first end 50 and the second end 54 of the resistance elastomeric tubing 46. The safety socks 56 may be made from braided nylon tubing, by way of example only and have a defined length secured to the first end 50 and the second end 54 of the resistance elastomeric tubing 46. Due to the manner in which the safety socks 56 are attached to the resistance elastomeric tubing 46, the safety socks 56 limit the degree of stretch the resistance elastomeric tubing 46 extends.

Furthermore the use of elastomeric tubing provides for a cushioned accessory with no metal parts, therefore limiting the possibility of injury from the removable resistance members 30. The safety socks 56 may also be made from material that is UV resistant so as to protect the removable resistance members 30 from fading. The safety socks 56 furthermore protect the removable resistance members 30 from scratches and rubbing. The removable resistance members 30 may also be adjustable static arm bands 58 having handles 60 at one end 62 and a flexible loop 64 at a second end 62 adapted to engage the attachment zones 38, 39 and 42. The adjustable static arm bands 58 may include Velcro® and ladder locks to easily adjust the length of the adjustable static arm bands 58 to accommodate for the different lengths of user's arms.

Referring to FIGS. 2 and 7 to 9 the adjustable support member 12 can be adjusted into different positions to accommodate the desired exercise and level of fitness of the user. For example the adjustable support member 12 can be adjusted to a 90° locked position about the hinged point using a lockable adjusting mechanism 66. The adjustable support member 12 may also be positioned into a 45° position, a 180° or flat position or a 0° or collapsed position. The lockable adjusting mechanism 66 may include a biased lever 68 that moves a locking pin 70 between engaged and disengaged positions thereby allowing for the repositioning of the adjustable support member 12 into various positions noted above. In the collapsed position the T-bar arm member 26 and the T-bar foot member 28 may be removed from the adjustable support member 12 by releasing the locking pins 27 and 41 thereby readying the portable, collapsible exercise machine 10 into a format ready for easy transport.

As noted above the attachment zones 38, 39 and 42 may have different accessories attached to provide a wide variety of exercises using different muscle groups while only having to use one machine. By way of example only a long bar with a first end and a second end and having removable resistance members 30 at the first and second ends may be attached to the attachment zone 38 on both sides of the adjustable support member 12 so as mimic a kayak paddle. While the removable resistance members 30 provide resistance similar to the paddle going through the water, the long bar provides support to the user similar to the paddle. Furthermore a wide variety of exercises may be attempted, for example triceps roll downs, curls, and assisted sit-ups may be safely attempted by users with varying skill and fitness.

Other variations and modifications of the invention are possible. All such modifications or variations are believed to be within the sphere and scope of the invention as defined by the claims appended hereto.

I claim:

1. A portable, collapsible exercise machine comprising:

(a) an adjustable support member having a first portion having a first end and a second end and a second portion having a first end and a second end;

(b) a removable, adjustable T-bar arm member adapted to adjustably engage the first end of the first portion;

(c) a removable, adjustable T-bar foot member adapted to adjustably engage the second end of the second portion, wherein the removable, adjustable T-bar foot member comprises an adjustable foot anchor that rotates about the adjustable T-bar foot member;

(d) removable resistance members adapted to engage the adjustable support member, the removable, adjustable T-bar arm member and the removable, adjustable T-bar foot member, wherein the second end of the first portion is hinged to the first end of the second portion at a point allowing the first and second portions to fold back onto one another into a collapsed position.

2. A portable, collapsible exercise machine as claimed in claim 1 wherein the first portion is a padded back support member and the second portion is a padded seat support member.

3. A portable, collapsible exercise machine as claimed in claim 2 wherein the hinged point connecting the first and second portions, further comprises a series of attachment zones adapted to engage the removable resistance members.

4. A portable, collapsible exercise machine as claimed in claim 3 wherein the removable, adjustable T-bar arm member further comprises a series of attachment zones adapted to engage the removable resistance members.

5. A portable, collapsible exercise machine as claimed in claim 1 wherein the removable, adjustable T-bar foot member further comprises a series of attachment zones adapted to engage the removable resistance members.

6. A portable, collapsible exercise machine as claimed in claims 3, 4 or 5 wherein the attachment zones are pigtail loops.

7. A portable, collapsible exercise machine as claimed in claim 1 wherein the removable resistance members are further defined as resistance elastomeric tubing.

8. A portable, collapsible exercise machine as claimed in claim 7 wherein the elastomeric tubing provides resistance between 0 and 140 pounds.

9. A portable, collapsible exercise machine as claimed in claim 8 wherein the resistance elastomeric tubing has flexible handles at a first end and a flexible loop at a second end adapted to engage the attachment zones.

10. A portable, collapsible exercise machine as claimed in claim 9 wherein the removable resistance members further comprise safety socks encompassing the removable resistance members and secured to the first end and the second end of the resistance elastomeric tubing.

11. A portable, collapsible exercise machine as claimed in claim 10 wherein the safety socks are made from braided nylon tubing having a defined length secured to the first end and the second ends of the resistance elastomeric tubing.

12. A portable, collapsible exercise machine as claimed in claim 11 wherein the safety socks are UV resistant.

13. A portable, collapsible exercise machine as claimed in claim 3 wherein the removable resistance members are further defined as adjustable static arm bands having handles at one end and a flexible loop at a second end adapted to engage the attachment zones.

14. A portable, collapsible exercise machine as claimed in claim 1 wherein the adjustable support member can be adjusted into a 90° locked position about the hinged point by a lockable adjusting mechanism.

15. A portable, collapsible exercise machine as claimed in claim 1 wherein the adjustable support member can be adjusted into a 45° locked position about the hinged point a lockable adjusting mechanism.

16. A portable, collapsible exercise machine as claimed in claim 1 wherein the adjustable support member can be adjusted into a 180° locked position about the hinged point a lockable adjusting mechanism.

17. A portable, collapsible exercise machine as claimed in claim 1 wherein the adjustable support member can be adjusted into a 0° locked and collapsed position about the hinged point a lockable adjusting mechanism.

18. A portable, collapsible exercise machine as claimed in claim 1 further comprising a long bar with a first end and a second end and having removable resistance members at the first and second ends adapted to engage the adjustable support member.

* * * * *